US009097091B2

(12) United States Patent
McHugh

(10) Patent No.: US 9,097,091 B2
(45) Date of Patent: Aug. 4, 2015

(54) SUBSEA RETRIEVABLE INSERT WITH CHOKE VALVE AND NON RETURN VALVE

(75) Inventor: Edmund McHugh, Longford Town (IE)

(73) Assignee: Cameron International Corporation, Houston, TX (US)

( * ) Notice: Subject to any disclaimer, the term of this patent is extended or adjusted under 35 U.S.C. 154(b) by 1203 days.

(21) Appl. No.: 13/004,858

(22) Filed: Jan. 11, 2011

(65) Prior Publication Data

US 2012/0174993 A1 Jul. 12, 2012

(51) Int. Cl.
*F16K 15/00* (2006.01)
*E21B 34/04* (2006.01)

(52) U.S. Cl.
CPC ..... *E21B 34/04* (2013.01)

(58) Field of Classification Search
CPC ..... E21B 34/04
USPC ..... 137/454.2, 512, 512.1, 512.3, 515.3, 137/599.18, 454.5; 251/118
See application file for complete search history.

(56) References Cited

U.S. PATENT DOCUMENTS

| | | | | |
|---|---|---|---|---|
| 1,861,396 | A * | 5/1932 | Isbell | 137/454.2 |
| 2,609,857 | A * | 9/1952 | McQuiston | 152/418 |
| 3,032,063 | A * | 5/1962 | Wells | 137/599.18 |
| 3,297,344 | A | 1/1967 | Hanes | |
| 3,455,578 | A | 7/1969 | Hanes | |
| 3,912,009 | A | 10/1975 | Davis | |
| 3,929,355 | A | 12/1975 | Slujusar | |
| 4,138,148 | A | 2/1979 | Zaremba | |
| 4,277,875 | A | 7/1981 | Worrell | |
| 4,333,531 | A | 6/1982 | Lawson | |
| 4,364,587 | A | 12/1982 | Samford | |
| 4,405,016 | A | 9/1983 | Best | |
| 4,433,859 | A | 2/1984 | Driver et al. | |
| 4,441,740 | A | 4/1984 | Cowan et al. | |
| 4,441,741 | A | 4/1984 | Galle | |
| 4,496,172 | A | 1/1985 | Walker | |
| 4,501,443 | A | 2/1985 | Haring | |
| 4,526,406 | A | 7/1985 | Nelson | |
| 4,593,937 | A | 6/1986 | Schawann et al. | |
| 4,796,922 | A | 1/1989 | Prichard | |
| 4,893,842 | A | 1/1990 | Brammer | |
| 4,941,534 | A | 7/1990 | Berzin | |
| 4,962,579 | A | 10/1990 | Moyer | |
| 5,026,200 | A | 6/1991 | Van Bilderbeek | |

(Continued)

FOREIGN PATENT DOCUMENTS

| | | |
|---|---|---|
| GB | 948331 | 1/1964 |
| GB | 2197675 A | 5/1988 |

(Continued)

OTHER PUBLICATIONS

PCT International Search Report for PCT Application No. PCT/US2012/020842 dated May 29, 2013.

*Primary Examiner* — Kevin Lee
*Assistant Examiner* — P. Macade Nichols
(74) *Attorney, Agent, or Firm* — Fletcher Yoder P.C.

(57) ABSTRACT

The disclosed embodiments provide a flow control insert having both a choke valve configured to control flow and pressure through the system and a check valve disposed along a fluid flow path along which the fluid flows. In accordance with the present embodiments, the flow control insert couples together the choke valve and the check valve, and the flow control insert is independently insertable and retrievable relative to a flow control housing.

27 Claims, 9 Drawing Sheets

(56) References Cited

U.S. PATENT DOCUMENTS

| | | | |
|---|---|---|---|
| 5,163,514 | A | 11/1992 | Jennings |
| 5,631,563 | A | 5/1997 | Moriarty |
| 5,799,949 | A | 9/1998 | Beall |
| 6,062,312 | A | 5/2000 | Wilkins |
| 6,237,964 | B1 | 5/2001 | Ostergaard |
| 6,260,624 | B1 | 7/2001 | Pallini et al. |
| 6,283,152 | B1 | 9/2001 | Corte, Jr. |
| 6,554,324 | B1 | 4/2003 | Herman |
| 6,609,734 | B1 | 8/2003 | Baugh |
| 7,344,162 | B2 | 3/2008 | Van Bilderbeek |
| 7,377,555 | B2 | 5/2008 | Smith |
| 7,469,931 | B2 | 12/2008 | Biester |
| 2005/0146137 | A1 | 7/2005 | Davidson et al. |
| 2007/0017586 | A1 | 1/2007 | Bohaychuk |
| 2007/0290503 | A1 | 12/2007 | McHugh et al. |

FOREIGN PATENT DOCUMENTS

| | | | |
|---|---|---|---|
| GB | 2202561 | A | 9/1988 |
| GB | 2410963 | A | 8/2005 |
| NO | 160026 | | 1/1964 |
| NO | 161342 | | 11/1988 |
| NO | 163546 | | 3/1989 |
| NO | 165390 | | 10/1990 |
| NO | 165630 | | 12/1990 |
| NO | 167600 | | 12/1991 |
| NO | 168847 | | 12/1991 |
| NO | 176937 | | 3/1995 |
| NO | 308269 | | 8/2000 |

* cited by examiner

SUBSEA RETRIEVABLE INSERT WITH CHOKE VALVE AND NON RETURN VALVE

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

In certain systems, such as mineral extraction systems and/or water injection systems, a variety of flow control devices are used to control a flow rate, a pressure, and other parameters of a fluid flow. These flow control devices may include valves, pressure regulators, meters and gauges, and chokes. In mineral extraction systems, the flow control devices regulate the flow of production fluid (e.g., oil) from a well. In water injection applications, the flow control devices regulate the flow of water that is injected via flow lines from the surface into a reservoir.

In subsea environments, access to flow control devices generally requires a trip from a surface platform to the seabed. For example, a diver, a remotely operated vehicle (ROV), or a running tool may be lowered to the equipment at the seabed. Unfortunately, it may require multiple trips to extract different flow control devices, such as a choke and a non-return valve.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

As noted above, it may be desirable to include features within a subsea water injection system and/or subsea mineral extraction system for stopping, starting, or otherwise controlling a fluid flow through the system to stabilize pressures and maintain workable operational parameters. Unfortunately, many such features typically require assembly in a piecemeal fashion, which can require more than one trip (i.e., multiple trips) by a ROV, or running tool. The present embodiments overcome these and other shortcomings of existing approaches and systems by providing a flow control insert having both a choke valve an a non-return valve (e.g., a check valve) coupled together. The choke valve is configured to restrict or choke a fluid flow along a fluid flow path through the insert. The check valve is configured to limit flow to only one direction. For example, the check valve may enable production flow of oil from a well, while blocking a return flow into the well. In accordance with the present embodiments, the flow control insert couples together the choke valve and the check valve, and the flow control insert is independently insertable and retrievable relative to a flow control housing. In some embodiments, the flow control insert locks into the flow control housing a dog-in-window locking mechanism. Therefore, when desired, the insert having the choke valve, check valve, and locking mechanism may be retrieved in a single trip using a running tool, ROV, and/or a diver.

Figure 1:
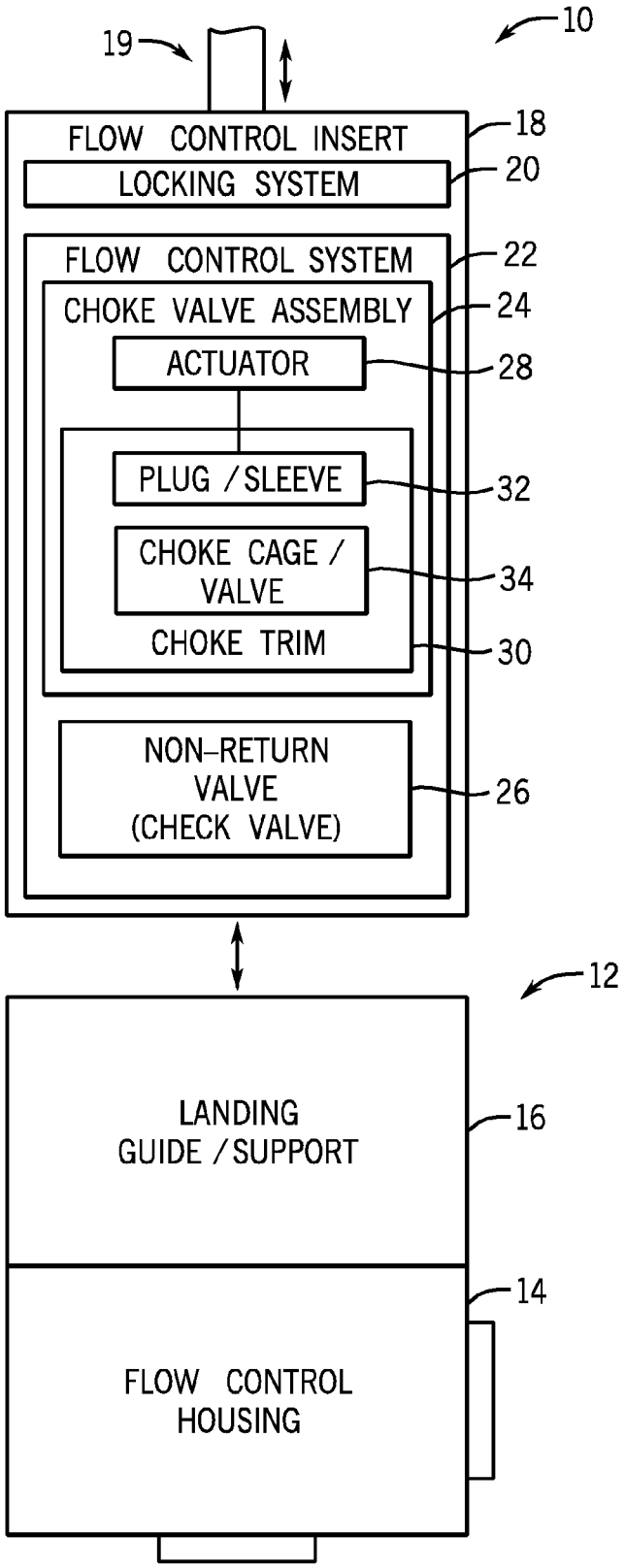
FIG. 1 is a block diagram of an embodiment of a flow control insert and a flow control housing having a landing guide/support.

Various features and aspects of these presently contemplated embodiments may be further appreciated with reference to FIG. 1, which is a block diagram of an embodiment of a choke portion 10 of a subsea water injection and/or mineral extraction system. Specifically, the flow control system 10 includes a non-retrievable portion 12 having a flow control housing 14 (e.g., a choke body) coupled to a landing guide/support 16. It should be noted that while the non-retrievable portion 12 is presently described as being substantially permanent, such language is intended to distinguish it from a portion that may be retrieved on a more frequent basis, and is not intended to limit the scope of the present disclosure. That is, the flow control housing 14 and the landing guide/support 16 are permanent with respect to a retrievable flow control insert 18 of the flow control system 10. However, in other embodiments, such as during or after well closure, the flow control housing 14 may be retrieved if desired.

In a general sense, FIG. 1 illustrates the flow control insert 18 during the process of being deployed, wherein the flow control insert 18 is deployed subsea using one or more suitably configured features of an offshore drilling system, such as a running tool 19. A portion of the running tool 19 is illustrated as attached to the flow control insert 18. The flow control insert 18 generally includes a locking system 20 configured to lock the flow control insert 18 into the flow control housing 14 and a flow control assembly 22 configured to control the flow of an injected and/or removed fluid when the insert 18 is in place. The flow control assembly 22 includes a choke valve assembly 24 and a non-return valve 26 (i.e., a check valve).

A portion of the choke valve assembly 24 and the non-return valve 26 are generally positioned along a fluid flow path. The choke valve assembly 24 includes, as noted above, various features for controlling fluid pressure changes across the flow control system 10. Such features include an actuator 28 coupled to a choke trim 30. Specifically, the actuator 28 couples to a plug 32 that is configured to partially and/or completely occlude one or more flow paths extending through a choke cage 34, which is also a part of the choke trim 30. It should be noted that while the mechanism for occluding the choke cage 34 is presently described in context of a plug 32, other features such as a moveable sleeve may be utilized for the same purpose. In embodiments with a moveable sleeve, the sleeve may cover all or a portion of the choke cage 34 to restrict fluid flow. Alternatively or additionally, in some embodiments, the choke valve assembly 24 may include a needle and seat choke trim, a fixed bean choke trim, a plug and cage choke trim, an external sleeve choke trim, a multistage choke trim as described herein, or any combination thereof. Moreover, while the choke valve assembly 24 is presently described as including a choke trim 30, in other embodiments the assembly 24 may not have a choke trim 30. That is, in certain embodiments, fluid may flow through the flow control insert 18 in a substantially open path or gallery where the plug 32 and the cage 34 (i.e. the choke trim 30) are positioned with respect to certain of the embodiments described herein.

To allow the fluid flow, the choke cage 34 may generally include a substantially hollow cylindrical structure having one or more ports (e.g., a perforated annular wall). The one or more ports of the choke cage 34 are configured to reduce fluid pressure of an incoming fluid by requiring the fluid to follow a circuitous path through the flow control assembly 22 before exiting the flow control system 10. In this way, the choke trim 30 may be a single or a multi-stage trim. Further, as will be appreciated, the ports of the choke cage 34 may be chosen for a particular application depending on the desired fluid dynamics and the specification of the well or other fluid source. Advantageously, the choke cage 34, and in some embodiments the choke trim 30, may be swappable (i.e., removable and replaceable) with respect to the flow control insert 18, for example by coupling onto a body or other feature of the insert 18 to allow a single flow control insert 18 to be used in a variety of applications.

Figure 2:
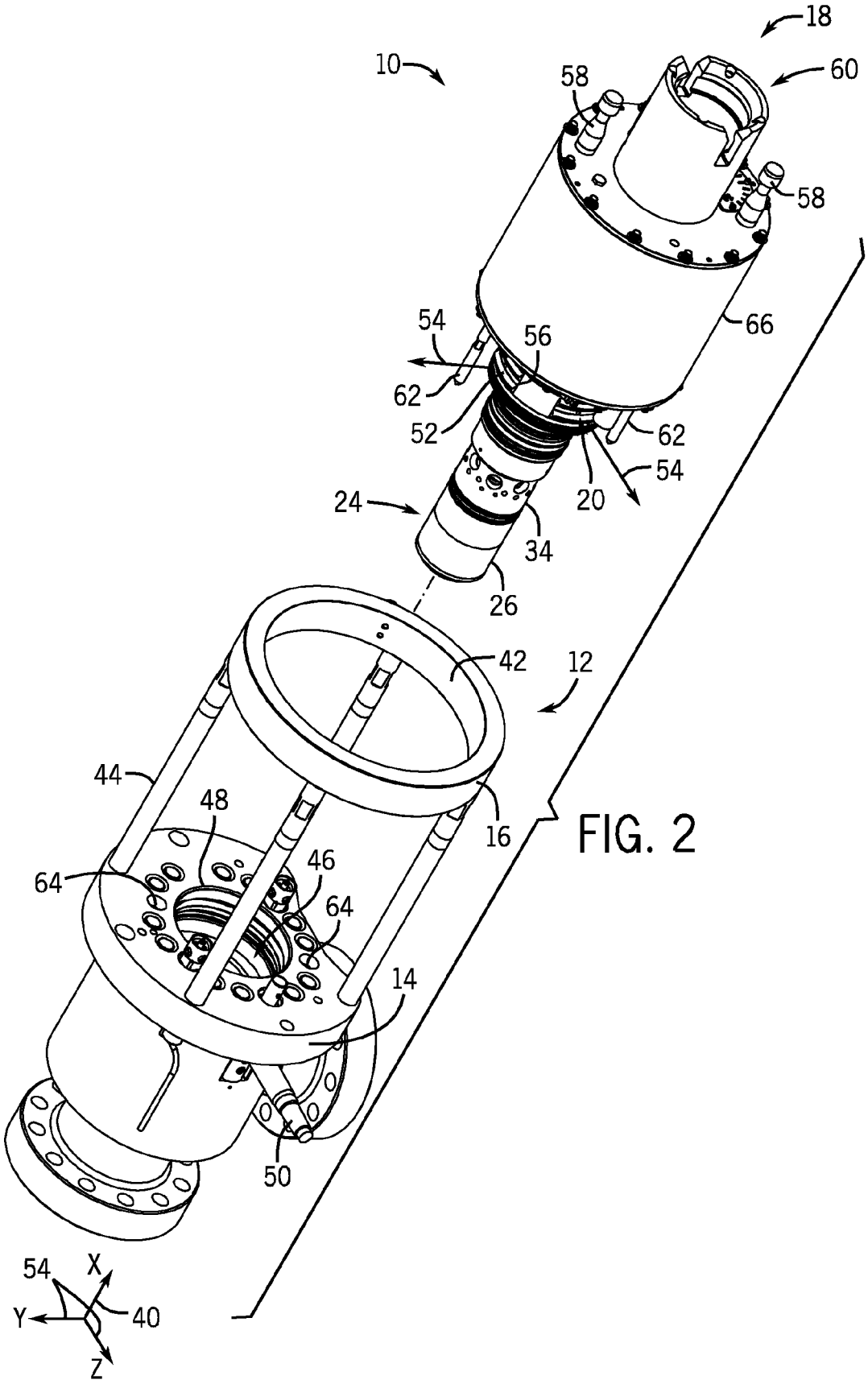
FIG. 2 is an exploded perspective view of an embodiment of the flow control insert and flow control housing having the landing guide/support of FIG. 1 prior to assembly.

An exploded perspective view of the flow control insert 18, the flow control housing 14, and the landing/support 16 prior to assembly is illustrated in FIG. 2. During assembly, the flow control insert 18 approaches the stationary portion 12 along a longitudinal axis 40, and is received by an annular member 42 of the landing/support 16 that is connected to the housing 14 by a plurality of support members 44. The annular member 42 receives and guides the flow control insert 18 towards an annular opening 46 of the flow control housing 14. Within the annular opening 46 of the housing 14 are specially-configured grooves or recesses 48 that are configured to interface with the locking system 20 of the flow control insert 18, as will be described in further detail below. The housing 14 also includes an electrical connector 50 (e.g., a female electrical connector) for allowing operation of various flow control features once the flow control system 10 has been assembled.

To enable interface between the flow control insert 18 and the flow control housing 14, the flow control insert 18 includes the locking mechanism 20 having a plurality of moveable members 52 that are capable of being cammed in a radial direction 54 out of respective openings 56 and into the recesses 48 of the flow control housing 14. The illustrated configuration may be referred to as a "dog-in-window" configuration, wherein the moveable members 52 or "dogs" move through respective windows to insert or "bite" into the recesses 48 of the housing 14. A plurality of push-pull rods 58 create the camming action that biases the moveable members 52 outward and allows the moveable members to move inward. The push-pull rods 58 each have engagement portions to which a running tool may attach for locking and unlocking the insert 18 into the housing 14 during insertion and removal operations. Additionally, the flow control insert 18 includes a handle portion 60 configured to receive and latch with a portion of a running tool, which allows the running tool to grab the insert 18 for insertion and retrieval. A plurality of guide rods 62 of the insert 18 are configured to insert into respective rod holes 64 of the flow control housing 14, which allows for proper alignment of the insert 18 with the housing 14 upon assembly.

The flow control insert 18 includes a cylindrical-shaped housing 66 that encloses various moveable parts that may be susceptible to corrosion by seawater. In some embodiments, the housing 66 is filled with a lubricant and sealed, which advantageously prevents the components internal to the housing 66 from being exposed to seawater. Moreover, the lubricant may prevent the ingress of contaminants or other debris that may deleteriously affect the operation of the internals of the insert 18. As an example, such internal features may include at least a portion of the actuator 28 as well as a mechanism for driving the push-pull rods 58, which are described in further detail below.

Generally, the area below the housing 66 is configured to interface with the flow control housing 14 and also to control various parameters of the fluid flow that will be received by the flow control system 10 during operation. As noted above, in addition to the flow control insert 18 having the choke valve assembly 24 for controlling fluid flow through the flow control system 10, the flow control insert 18 also couples the non-return valve 26 to the choke cage 34 (i.e., the choke trim 30) to prevent return flow during water injection and/or mineral extraction. In embodiments where no choke trim is present, the non-return valve 26 may be coupled to an open section or gallery where the choke trim 30 would normally be positioned. As illustrated, the non-return valve 26 is directly coupled to the choke trim 30. However, in other embodiments the non-return valve 26 may couple to the choke trim 30 via a support member, or one or more intermediate choke features depending on the particular configuration of the choke trim 30, among other things. Again, while the choke trim is presently described as including a choke cage 34 and plug 32, the choke valve assembly 24 may include a needle and seat choke trim, a fixed bean choke trim, a plug and cage choke trim, an external sleeve choke trim, a multistage choke trim as described herein, or any combination thereof. For example, in embodiments where the choke trim is a needle and seat choke trim, the needle may actuate in a similar manner to the plug 32 described with respect to the illustrated embodiment to close, restrict, or open a fluid flow through the seat. In a fixed bean configuration, an insert may be placed in the area of the choke cage 34, the insert being configured to constrict flow through the insert by reducing an internal diameter of the flow path 80 or 81. In an external sleeve configuration, as described above, a sleeve may reversibly occlude one or more fluid paths (i.e., ports) of a choke cage (i.e., choke cage 34) to restrict, open, or close fluid flow. Embodiments of a single or multistage choke trim are described with respect to the illustrated embodiments.

Alternatively or additionally, other types of valves may be positioned in the gallery wherein the choke trim 30 is normally placed. Such valves may include globe valves or similar flow restriction valves placed either as a single feature used for flow control, or in conjunction (i.e., series) with other flow control features. Again, in embodiments where a choke trim 30 may or may not be present, in accordance with presently contemplated embodiments, the choke valve assembly 24 and the non-return valve 26 are intended to be retrieved in a single trip along with the other features of the flow control insert 18.

Figure 3:
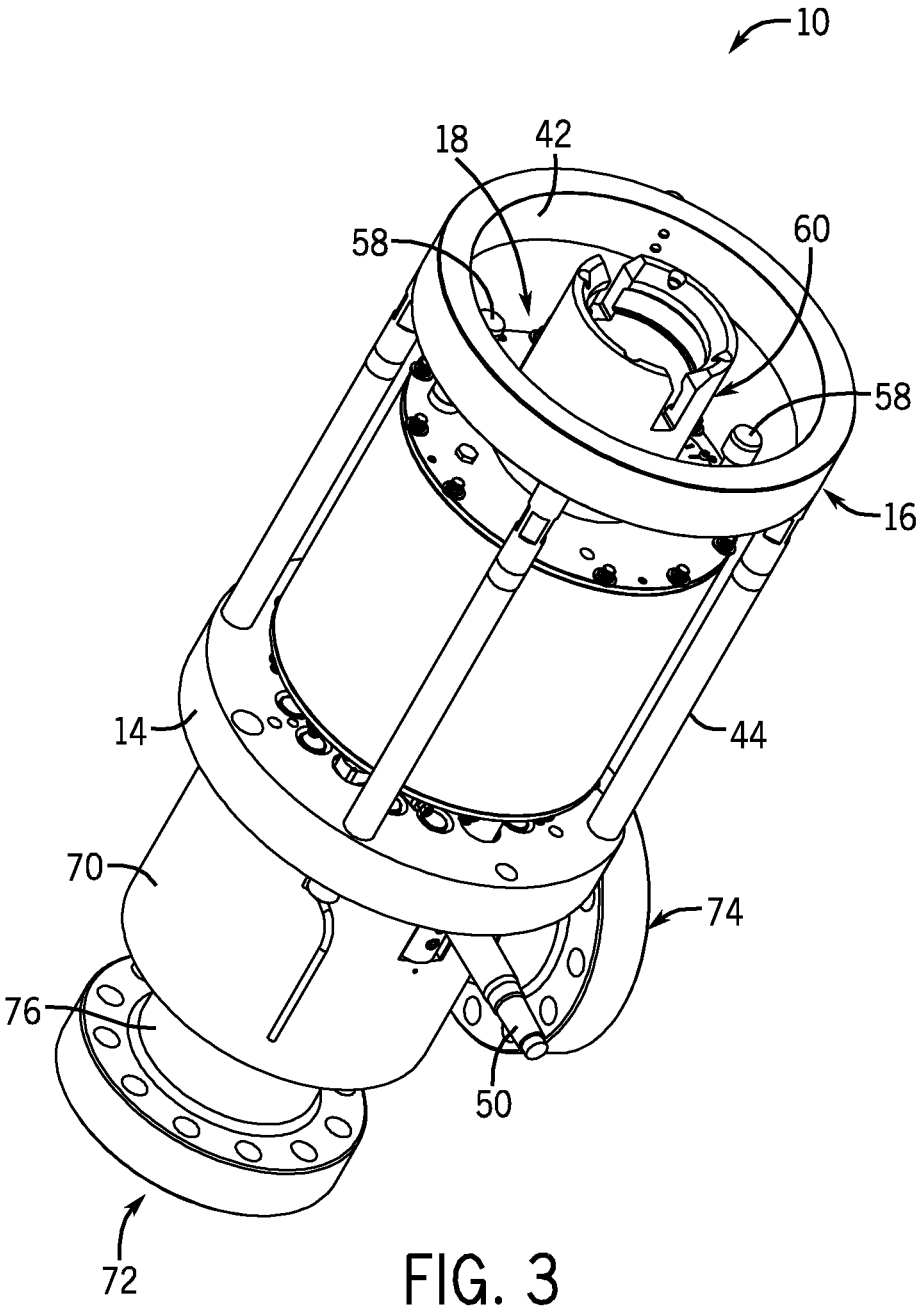
FIG. 3 is a perspective view of the flow control insert of FIG. 2 assembled into the flow control housing of FIG. 2.

Moving now to FIG. 3, the flow control insert 18 is illustrated as installed into the flow control housing 14 to form flow control system 10. It should be appreciated with reference to FIG. 3 that the flow control insert 18 may be accessed vertically using a running tool at the handle 60. Such access allows the insert 18 to be retrieved, or allows interventional operations to be performed subsea. Other portions of the flow control insert 18, such as the choke valve assembly 24, are not accessible and are disposed within a valve portion 70 of the flow control housing 14. Thus, in the illustrated embodiment, during operation the flow control system 10 receives fluid through inlet 72 and flows the fluid along a fluid path through the valve portion 70 and to an outlet 74, which may lead to a fluid collection apparatus or other suitably configured feature of a water injection and/or mineral extraction system. As noted above, the choke valve assembly 24 may constrict or otherwise alter the fluid path of the fluid to control the flow rate and pressure experienced by the flow control system 10 and thus, the water injection and/or mineral extraction system. The non-return valve 26 of the flow control insert 18 operates within a non-return valve area 76 of the flow control housing 14 between the valve portion 70 and the inlet 72. Again, the non-return valve 26 is attached to or otherwise integrated into the flow control insert 18 to allow the non-return valve 26 to be retrievable in conjunction with the flow control insert 18. During operation, the non-return valve 26 ensures that extracted fluids do not exit through the inlet 72.

Figure 4:
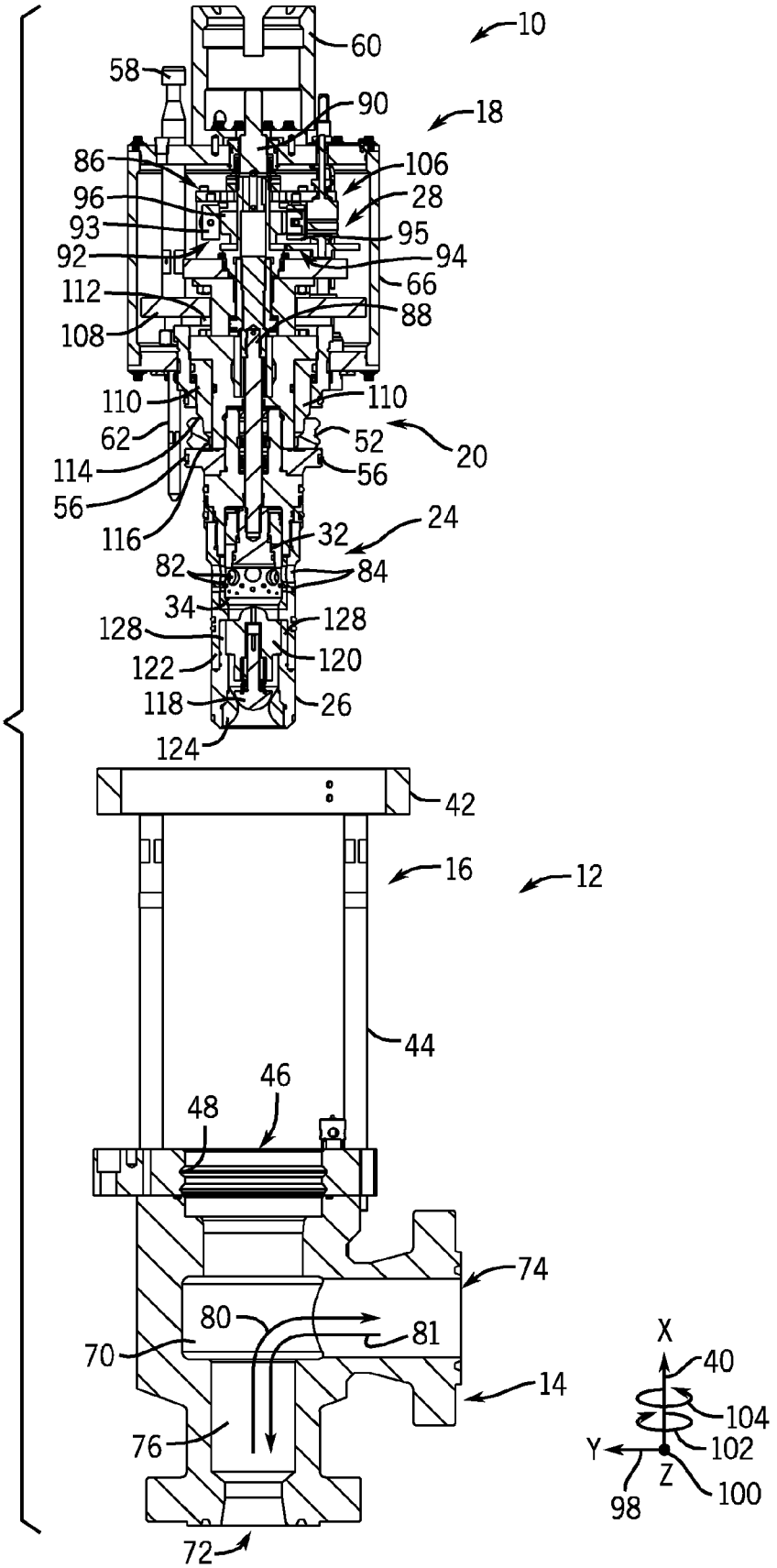
FIG. 4 is an exploded cross-sectional view of an embodiment of the flow control insert of FIG. 1 and the flow control housing having the landing/guide support of FIG. 1 prior to assembly.

FIG. 4 is an exploded cross-sectional plan view of the arrangement of FIG. 2, where the flow control insert 18 is approaching the flow control housing 14 (or being retrieved from the flow control housing 14). Specifically, the cross-sectional view of FIG. 4 illustrates various features of the actuator 28, the locking mechanism 20, the choke valve assembly 24, and the non-return valve 26 of the flow control insert 18. Additionally, the cross-sectional view of the flow control housing 14 illustrates a first fluid path 80 through which extracted fluids may flow through the flow control system 10 when assembled. However, in other embodiments, fluids may flow through the flow control system 10 via a second fluid path 81. In such embodiments, the non-return valve 26, which is described in further detail below, may be rotated 180° in the X-Y plane (i.e., in the plane of the longitudinal axis 40 and a crosswise axis 98).

The actuator 28, as noted above, generally controls the longitudinal displacement of the plug 32 to control the amount of fluid passing through the choke cage 34. Specifically, the plug 32 moves along the longitudinal axis 40 to occlude one or more interior ports 82 of the choke cage 34. The interior ports 82 of the choke cage 34 generally coincide with one or more exterior ports 84 of the choke cage 34. The interior ports 82 and the exterior ports 84 may be aligned and/or misaligned so as to cause fluid flowing through from the interior of the choke cage 34 to the exterior of the choke cage 34 to have a reduced flow rate and, therefore, a reduced pressure. In such an embodiment, the choke trim 30 may be considered a multi-stage choke trim, wherein pressure is reduced in more than one stage so as to prevent fluid cavitation from steep pressure drops. It should be noted, however, that the use of single-stage choke trims is also presently contemplated and may be used in accordance with the present disclosure.

To move the plug 32 along the longitudinal axis 40, the actuator 28 includes a hydraulically energized stepping mechanism 86 that causes the movement of a rod 88 attached to the plug 32 to actuate within a shaft 90. The stepping mechanism 86 includes a close pull assembly 92 and an open pull assembly 94 disposed at opposite diametrical extents of an annular force transmission gear 96 along a latitudinal axis 98. The closed pull assembly 92 and the open pull assembly 94 are generally configured to cause the movement of the plug 32 in a stepwise fashion between two positions. The two positions may be where the plug 32 completely occludes the choke cage 34 and where the plug 32 leaves the choke cage 34 completely open to the flow of fluid. In the illustrated embodiment, the plug 32, using the pull assemblies 92, 94, may move a percentage between each position. For example, in a single step, the plug may move between about 10% and about 50% of the distance between the two positions. Indeed, in some embodiments, the plug 32 may move 10%, 20%, 25%, 30%, 35%, 40%, 45%, 50%, or more of the distance between the two positions.

To create the longitudinal displacement of the plug 32, each of the pull assemblies 92, 94 include respective geared pulls 93, 95 that are attached at an end of a piston. The pull assemblies 92, 94 are displaced along a crosswise direction 100 to interface with and rotate the force transmission gear 96. For example, during a closing operation where the plug 32 is placed so as to occlude a portion of the choke cage 34, the close pull assembly 92 is hydraulically energized and extends along the crosswise direction 98. The geared pull of the close pull assembly 92 then gears into the force transmission gear 96, and is retracted along the crosswise direction 98, which causes the force transmission gear 96 to rotate about the longitudinal axis 40 in a first rotational direction 102. Each extension/retraction by the close pull assembly 92 (and the open pull assembly 94, as discussed below) may be considered as one of the steps noted above. The rotational motion of the force transmission gear 96 causes the rod 88 to move along the longitudinal axis 40 in a direction towards the flow control housing 14. This longitudinal displacement by the rod 88 results in the plug 32 partially or completely occluding one or more of the interior ports 82 of the choke cage 34, as is shown with respect to FIG. 7 below. Such a position may be referred to as a closed position.

To retract the plug 32, the open pull assembly 94 is hydraulically energized. The geared pull of the open pull assembly 94 is then displaced along the crosswise axis 100, and gears with the force transmission gear 96. The geared pull of the open pull assembly 94 is then retracted along the crosswise axis 100, which causes the force transmission gear 96 to rotate in a second rotational direction 104. The rotational motion of the force transmission gear 96 in the second rotational direction 104 causes the rod 88 to be retracted within the shaft 90, i.e., displaced in a direction away from the flow control housing 14 along the longitudinal axis 40. The retraction of the rod 88 results in the plug 32 no longer being in an occluding position. Such a position may be referred to as an open position. The displacement of the plug 32 may be monitored using a displacement indicator 106, which may include linear displacement couplings, dials, and so forth. The displacement indicator 106 may present a local indication of the position of the plug 32, may transmit the position of the plug 32 to another location (e.g., to a control system or other feature of a water injection and/or mineral extraction system), or both.

As noted above, various features of the locking mechanism 20 may also be appreciated with respect to FIG. 4. It should be noted that while a dog-in-window configuration is presently described to facilitate explanation, other locking mechanisms are also contemplated herein, such as clamps, collets, threads, snap fits, interference fits, one or more bonnet bolts, a bayonet, and so on. In the illustrated embodiment, the locking mechanism includes the moveable members 52 that are capable of being cammed radially outward (with respect to the longitudinal axis 40) to lock into the recesses 48 of the flow control housing 14. Again, one or more push-pull rods 58 cause the camming action of the moveable members 52. Specifically, in the illustrated embodiment, the push-pull rods 58 are each coupled to a force transmission plate 108. For example, the push-pull rods 58 may be bolted onto the force transmission plate 108, which causes the plate 108 to move along the same trajectory and travel as the rods 58. In embodiments where the push-pull rods 58 are pulled (i.e., to unlock the insert 18 from the housing 14), the force transmission plate 108 would travel upward in a direction generally parallel to the longitudinal axis 40 and away from the housing 14.

The force transmission plate 108 is coupled to one or more sliding sleeves 110 via one or more bolts 112. Thus, when the push-pull rods 58 are moved along the longitudinal axis 40, the sliding sleeve 110 is also displaced. The sliding sleeve 110 is disposed in abutment against the moveable members 52, and the sliding action of the sleeve 110 caused by displacing the push-pull rods 58 provides the camming action that drives the moveable members 52 (e.g., dogs) into and out of their respective openings 56 (e.g., windows). For example, in the illustrated embodiment, the sliding sleeve 110 includes a cammed surface 114 where an extent of the sleeve 110 is tapered along the same direction of travel of the moveable members 52 at the end of the sleeve 110 proximate the housing 14. The moveable members 52 also include respective cammed surfaces 116 with a taper that matches the cammed surface 114 of the sliding sleeve 110, which causes an inward and outward movement of the moveable members 52 when the sliding sleeve 110 is displaced along the axis 40. In the embodiment of FIG. 4, the locking mechanism 20 is illustrated in an unlocked position, which is the position of the locking mechanism 20 when the insert 18 is being installed into or removed from the housing 14.

Figure 6:
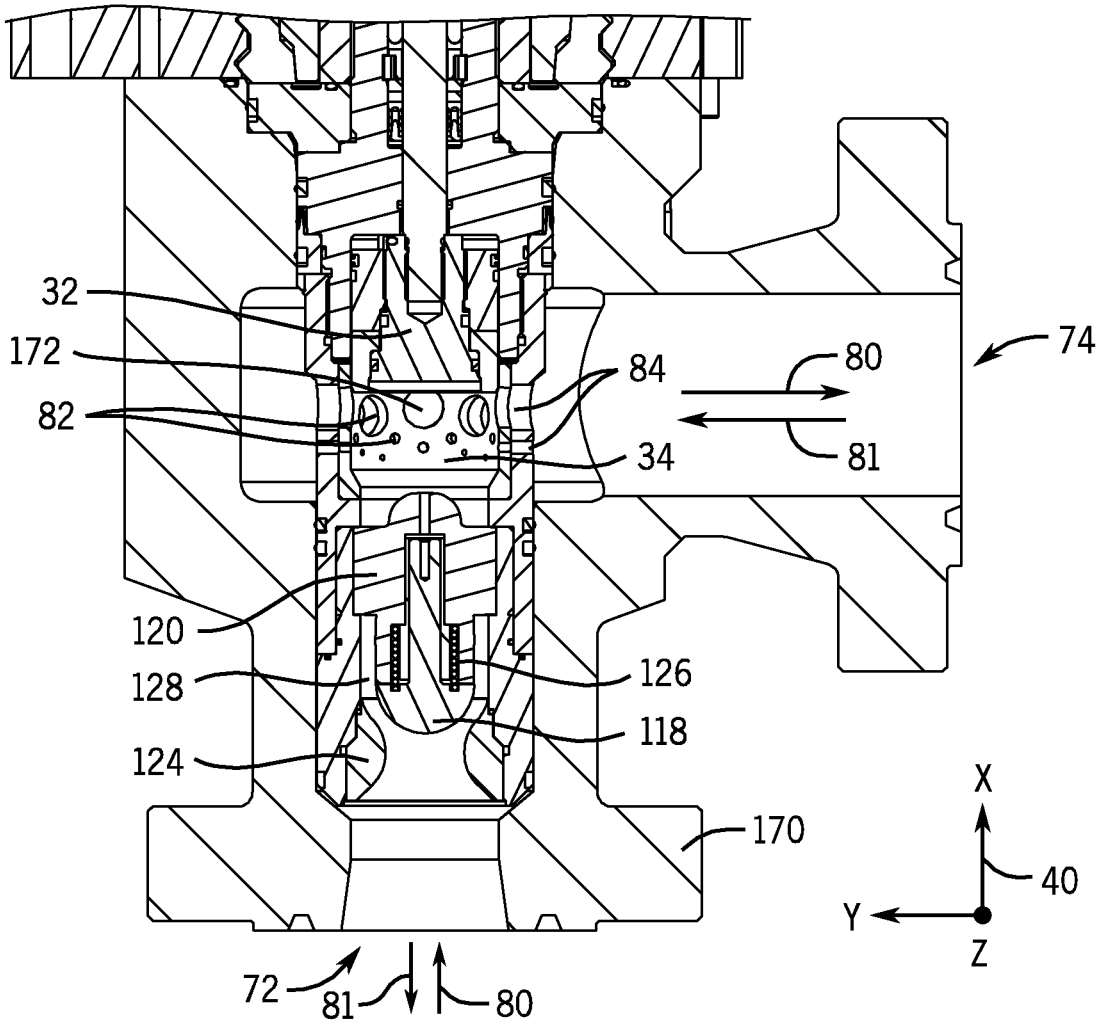
FIG. 6 is a cross-sectional view of the flow control insert and the flow control housing of FIG. 4 after assembly, wherein a non-return valve of the insert is in an open position.
Figure 7:
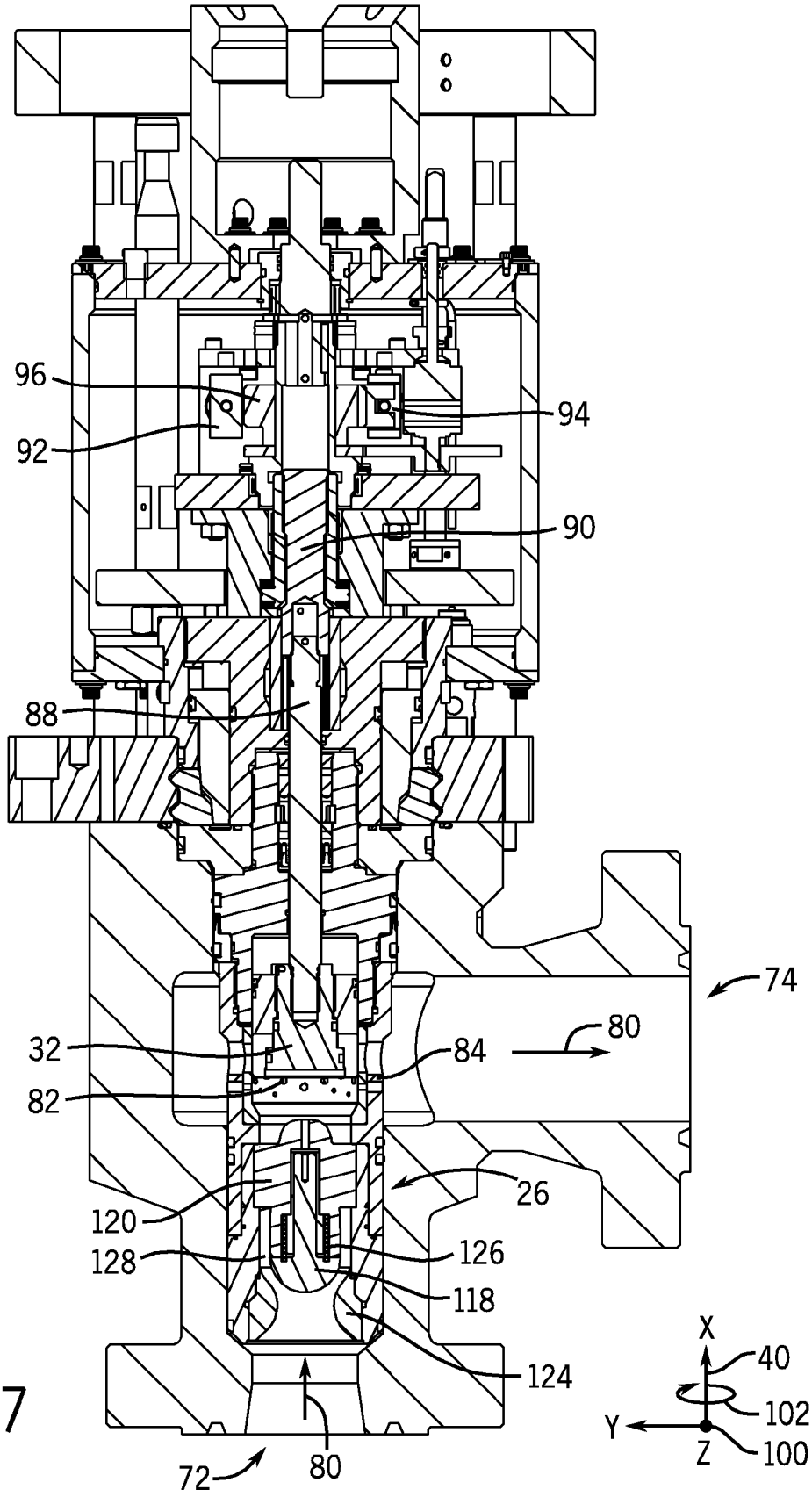
FIG. 7 is a cross-sectional view of the flow control insert and the flow control housing of FIG. 4 after assembly, wherein a plug of a choke trim of the insert is partially occluding a choke cage of the choke trim.

Also visible in the cross-sectional illustration of FIG. 4 are the various components of the non-return valve 26, which include a valve member 118 moveable along the longitudinal axis 40 within a cavity 120 of a housing 122 of the valve 26. The valve member 118 is generally biased by a spring 126 towards an abutment surface 124 of the housing 122, which may be an area of the housing 122 having a tapered surface configured to form a seal in conjunction with the valve member 118. During operation, the flow of fluid may overcome the spring force exerted by the biasing spring 126, which allows fluid to flow through one or more ports 128 defining a fluid passage as the valve member 118 moves away from the abutment surface 124, as depicted in FIGS. 6 and 7. When the fluid flow does not have sufficient pressure, or when reverse flow occurs, the biasing spring 126 may act to seal the non-return valve 26 by placing the valve member 118 in abutment with the abutment surface 124. In other words, the flow of the fluid is closed to the fluid passage formed by the ports 128. The closed position of the non-return valve 26 is depicted in FIGS. 4, 5, 8 and 9.

The operations described above may be performed once the flow control system 10 has been assembled by placing the flow control insert 18 into the flow control housing 14. For example, once the flow control insert 18 has been disposed in the flow control housing 14, the locking mechanism 20 may be engaged, the non-return valve 26 may begin to allow the flow of fluids, and the actuator 28 and choke trim 30 may act to control fluid flow. An embodiment of such an assembled flow control system 10 is illustrated as a cross-section in FIG. 5. In the illustrated embodiment, the insert 18 has been placed into the flow control housing 14 and the locking mechanism 20 has been activated. Therefore, the push-pull rods 58 have been pushed axially along the longitudinal axis 40 towards the housing 14, which causes the sliding sleeve 110 to also move downward and cam the moveable members 52 radially outward with respect to the longitudinal axis 40. It should be noted that the handle 60, i.e., the running tool interface, sits within the annular member 42 of the landing 16 to facilitate alignment and interface with a running tool, for example for engaging or disengaging the locking mechanism 20.

In some situations, it may be desirable to operate the locking mechanism 20 using one or more secondary features. Accordingly, the locking mechanism 20 may include one or more features such as hydraulic lines, hydraulic sources, and so on for driving the locking mechanism 20. Specifically, hydraulic fluid (e.g., water or oil) may be injected into a cavity 130 defined between the sliding sleeve 110 and a housing 132 partially enclosing various portions of the locking mechanism 20. Additionally, an inner seal 134 and an outer seal 136 are disposed on opposing sides of the sleeve 110 to prevent the ingress of seawater into the moving joints of the locking mechanism 20, specifically the joint between the sleeve 110 and the moveable members 52.

The moveable members 52 are supported by a lower support plate 138, which rests against the flow control housing 14. The lower support plate 138 is sealed against the housing 14 using a seal 140. Seal 140, in conjunction with a seal 142 disposed between a body 144 of the housing 14 and a top flange 146 of the housing 14, prevents the ingress of seawater or other contaminants into the locking mechanism 20 at an area proximate the lower support plate 138 and the moveable members 52. Additionally, a seal 148 is disposed between the housing 132 and the top flange 146 to seal an end of the moveable members 52 opposite the lower support plate 138 from seawater and other contaminants.

In addition to the seals proximate the locking mechanism 20, the insert 18 includes other seals disposed proximate the choke trim 30 and the non-return valve 26 for preventing exposure to seawater and damage to various components. For example, the choke trim 30 is flanked by two pairs of seals, e.g., an upper pair of seals 150 and a lower pair of seals 152 (e.g., a nose seal). A first seal 154 (e.g., a bonnet seal) of the upper seals 150 is disposed on the choke trim 30, and isolates an internal pressure within the choke trim 30 from the environment surrounding the insert 18 (e.g., seawater). A second seal 156 of the upper seals 150 is disposed on a hub 158 of the insert 18, and seals against the housing 14. The hub 158 is generally configured to allow attachment of the choke trim 30 to the insert 18 and to support the lower support plate 138. The lower seals 152 are disposed on the choke trim 30 below the valve area 70 of the housing 14, and are configured to isolate the upstream pressure of the insert 18 from the downstream pressure of the insert 18. A bumper ring 160 is disposed on the non-return valve 26 for sealing the non-return valve 26 against the housing 14 and also for providing a degree of impact absorption for the impact that may be experienced when the insert 18 is disposed within the housing 14 during assembly.

Figure 5:
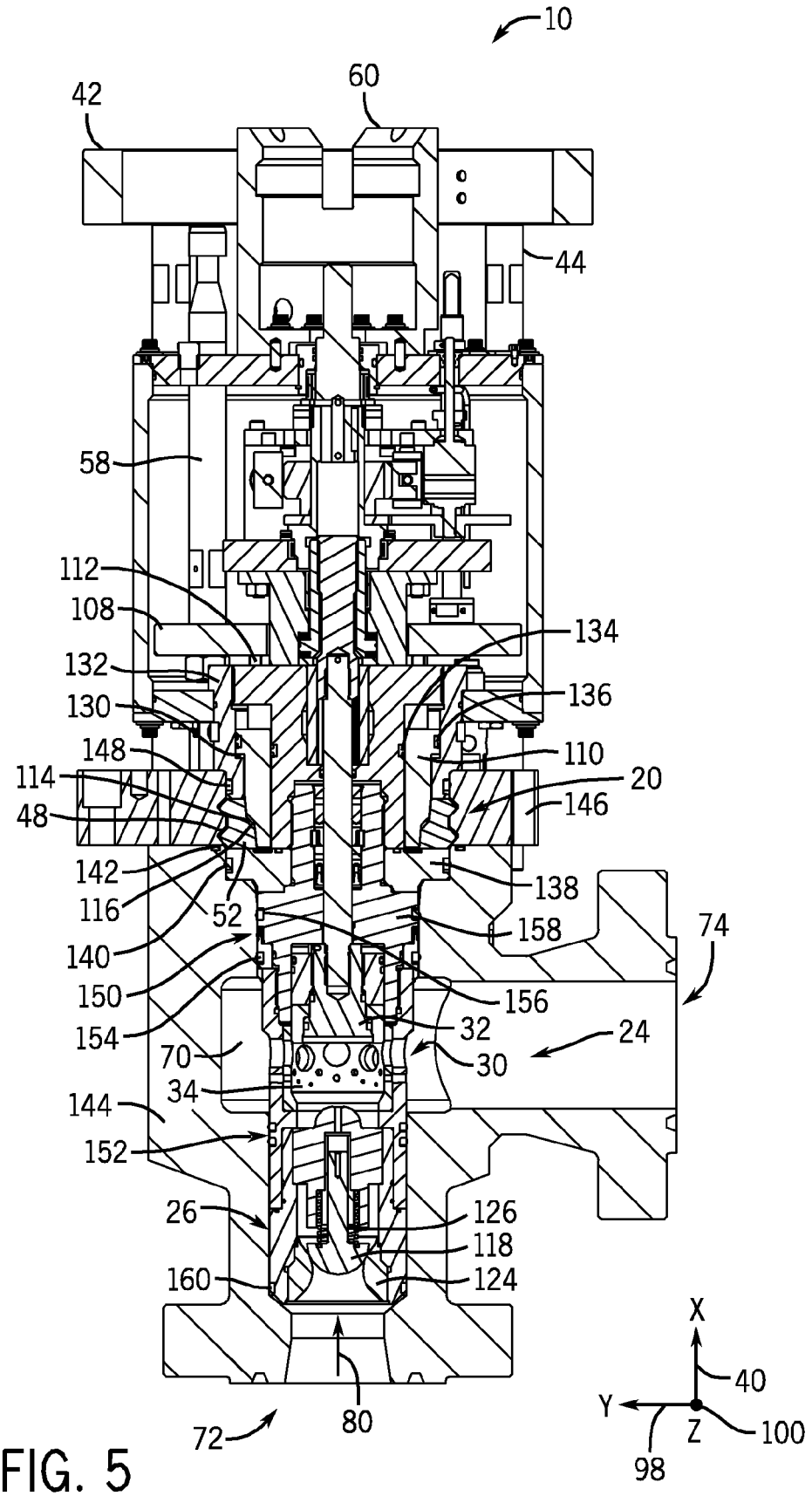
FIG. 5 is a cross-sectional view of the flow control insert and the flow control housing of FIG. 4 after assembly.

It should be noted that in the configuration of the non-return valve 26 illustrated in FIG. 5, fluid may not be able to flow from the inlet 72 via the flow path 80 and through the choke cage 34. For example, the configuration of the non-return valve 26 illustrated in FIG. 5 may be representative of a low flow, return flow, or no flow situation. That is, the spring force exerted by the biasing spring 126 is sufficient to drive the valve member 118 into abutment against the abutment surface 124.

Conversely, in situations of fluid retrieval where the fluid has a sufficient pressure to overcome the spring force of the spring 126, the valve member 118 may move axially along the longitudinal direction 40 and away from the abutment surface 124, which is depicted in FIG. 6. Specifically, FIG. 6 illustrates the non-return valve 26 in an open position wherein flow may traverse the non-return valve 26, flow through the choke cage 34, and out of the outlet 74. In the illustrated embodiment, the non-return valve 26 the compressed biasing spring 126 has been overcome by a fluid flow having sufficient pressure. Because the spring 126 is compressed, the valve member 118 moves axially away from the abutment surface 124 along the longitudinal axis 40, which opens the fluid path to the ports 128. It should be noted that in some embodiments, fluid flow may be constricted as fluid passes from the inlet 74 at a lower flange 170 of the housing 14 and through the flow through ports 128. Advantageously, such flow constriction may serve as a pressure reduction stage in the overall fluid flow dynamics of the flow control system 10. In other embodiments, as mentioned above, the non-return valve 26 may be rotated 180° in the X-Y plane (i.e., in the plane of the longitudinal axis 40 and a crosswise axis 98) such that a fluid flows from outlet 74, through the choke cage 34, and out of the inlet 72. In such a configuration, the valve member 118 may be disposed proximate the choke cage 34 and the ports 128 may lead to the inlet 72, with the fluid flowing along the second fluid path 81.

Once the fluid flow passes through the ports 128 of the non-return valve 26, the fluid enters into an internal cavity 172 of the choke cage 34. The fluid then passes through one or more of the internal ports 82, through one or more external ports 84, out of the choke cage 34, and out of the outlet 74. As noted above, the internal and external ports 82, 84 serve to adjust the fluid dynamics of a fluid that is extracted from a well or other fluid source.

In addition to the ports 82, 84, the flow control insert 18 includes the plug 32 for adjusting fluid flow through the flow control system 10. An embodiment of such fluid flow adjustment is illustrated in FIG. 7, which is a cross-sectional view of the plug 32 being positioned to occlude at least a portion of the choke cage 34. As noted above, the plug 32 may be actuated axially along the longitudinal axis 40 to partially or completely occlude the ports 82, 84 of the choke cage 34. Again, to actuate the plug 32 to occlude at least a portion of the ports 82, 84, the close pull assembly 92 actuates along the crosswise direction 100, gears with the force transmission gear 96, and retracts along the crosswise direction 100 to rotate the gear 96 in the first rotational direction 102 about the longitudinal axis 40. The rotation of the gear 96 results in downward motion of the rod 88, which causes the plug 32 to close the various ports of the choke cage 34. In this way, the close pull assembly 92 acts to constrict flow through the flow control system 10, and, in some embodiments, completely stop the flow through the flow control system 10.

As noted above, the present disclosure provides for the flow control insert 18 to couple the choke valve assembly 24, which includes the actuator 28 and the choke trim 30, with the non-return valve 26 to form a single unit. In this way, the non-return valve 26 may be independently coupled to the choke valve assembly 24, or may be formed as an integral part of the choke valve assembly 24. That is, the non-return valve 26 and at least a portion of the choke valve assembly 24 (e.g., the choke trim 30) may have a common wall. Such embodiments are described below with respect to FIGS. 8-11.

Figure 8:
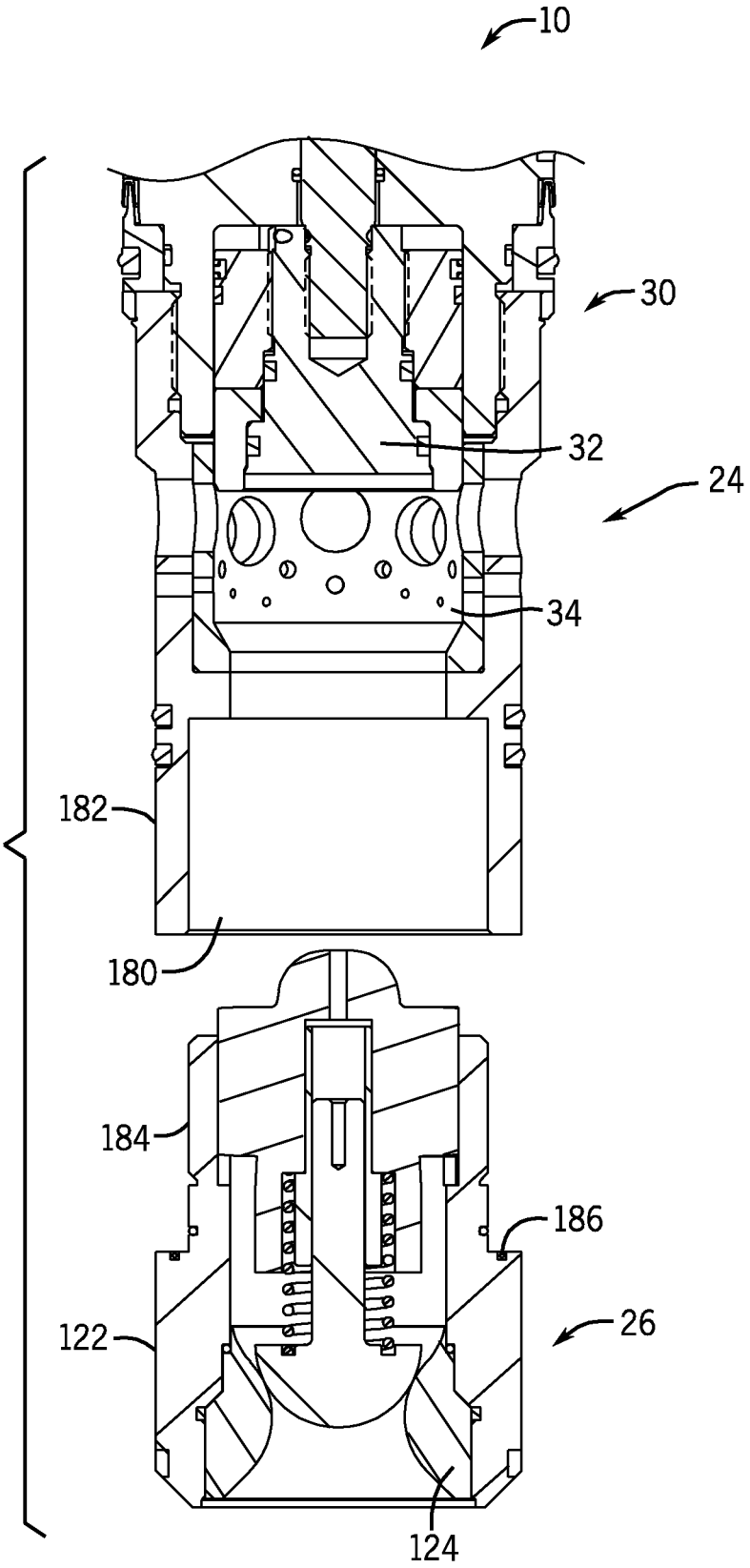
FIG. 8 is an exploded cross-sectional view of the choke trim and the non-return valve of FIG. 5.

Specifically, FIG. 8 illustrates a cross-sectional view of the choke trim 30 separated from the non-return valve 26, wherein the choke trim 30 and non-return valve 26 have features for a removable connection. In the illustrated embodiment, the choke trim 30 includes a cavity 180 within an external housing 182 that is configured to receive a section 184 of the non-return valve 26 having a reduced diameter compared to the area proximate the abutment surface 124. In this way, the cavity 180 may be considered a choke mount that is configured to couple the choke trim 30 with the non-return valve 26. As an example, the section 184 may be configured to thread into the cavity 180 of the choke trim 30. In an embodiment, the non-return valve 26 may include first threads and the choke trim 30 may include second threads, and the first and second threads may couple together to join the non-return valve 26 to the choke trim 30. An annular seal 186 is provided to provide a seal between the choke trim 30 and the non-return valve 26 when combined to prevent the ingress of seawater into the joint formed between the choke trim 30 and the non-return valve 26.

Figure 9:
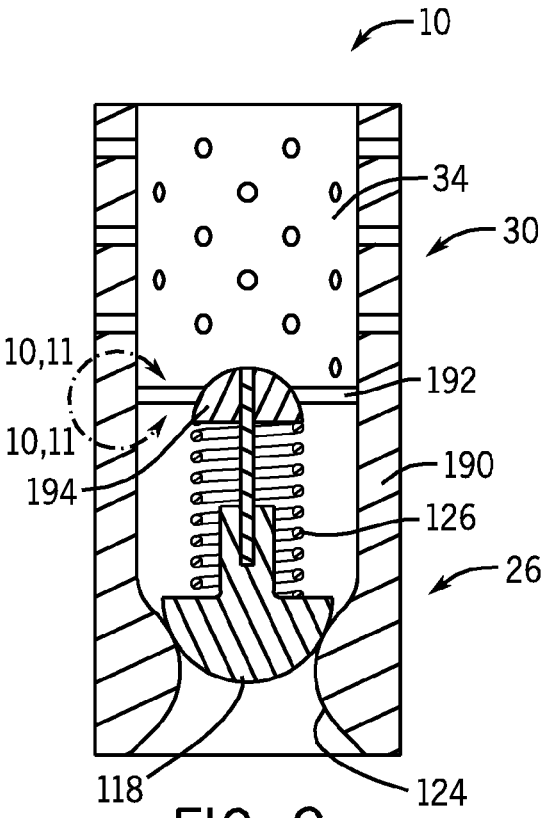
FIG. 9 is a cross-sectional view of an embodiment of a choke trim and a non-return valve of the flow control insert of FIG. 1 having a common wall.

In other embodiments, the choke trim 30 and the non-return valve 26 may be formed as a single piece, an embodiment of which is illustrated in FIG. 9. In the illustrated embodiment, the non-return valve 26 and the choke trim 30 are depicted as having a common wall 190 (e.g., a common sleeve), i.e., there is no substantial break from one to the other. The wall 190 (e.g., sleeve) is coupled to or includes an annular support structure 192, which supports a core 194 of the valve member 118. The annular support structure 192 braces the core 194 for the force of the biasing spring 126 as well as the fluid that enters the valve 26 during flow.

While the non-return valve 26 may be formed as an integral part of the choke trim 30, the present embodiments also may couple together the non-return valve 26 and the choke trim 30 with other fastening techniques, such as a weld, a braze, bolts, interference fits, locking rings, and so forth. Thus, the flow control insert 18 may be originally manufactured as an assembly with both the choke trim 30 and the non-return valve 26, or a retrofit kit may be used to attach the non-return valve 26 to an insert 18 having the choke trim 30.

Figure 10:
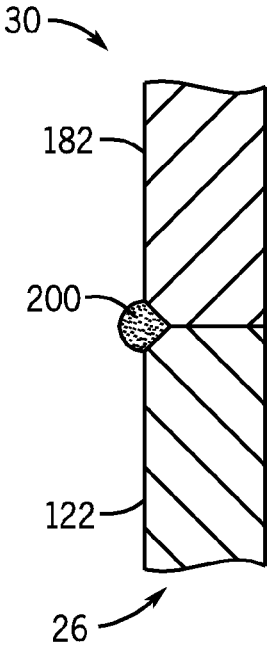
FIG. 10 is a cross-sectional view of an embodiment of a choke trim and a non-return valve of the flow control insert of FIG. 1 connected via a weld or braze.
Figure 11:
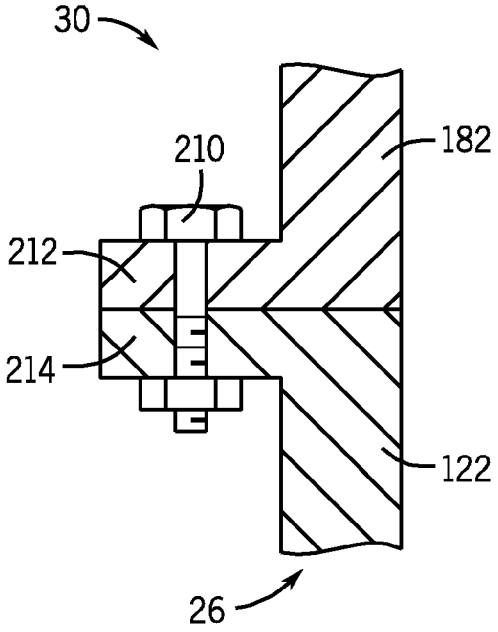
FIG. 11 is a cross-sectional view of an embodiment of a choke trim and a non-return valve of the flow control insert of FIG. 1 connected via one or more bolts.

Specifically, FIG. 10 illustrates an embodiment where the body 182 of the choke trim 30 and the body 122 of the non-return valve 26 are coupled together via a braze and/or weld 200. FIG. 11 illustrates an embodiment where the body 182 of the choke trim 30 and the body 122 of the non-return valve 26 are coupled together via one or more bolts 210. For example, the body 182 of the choke trim 30 may include a flange 212, and the body 122 of the non-return valve 26 may include a matching flange 214, and the flanges 212, 214 may be coupled together using the one or more bolts 210.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a subsea fluid injection system or a mineral extraction system, comprising:

a flow control housing;

a flow control insert disposed in the flow control housing, wherein the flow control insert comprises a choke valve having a first valve member and a check valve having a second valve member disposed along a fluid flow path, the choke valve and the check valve are structurally different from one another, the first and second valve members are configured to move independent from one another, and the flow control insert couples together the choke valve and the check valve; and an actuator selectively controllable to adjust a choked flow through the choke valve.

2. The system of claim 1, wherein the flow control insert is independently insertable and retrievable relative to the flow control housing.

3. The system of claim 2, wherein the flow control insert comprises a running tool interface.

4. The system of claim 1, wherein the flow control insert comprises a locking system configured to removably interlock the flow control insert with the flow control housing, the locking system comprising a dog-in-window mechanism, a threaded mechanism, a clamping mechanism, a collet, one or more bonnet bolts, a bayonet, or any combination thereof.

5. The system of claim 4, wherein the locking system comprises the dog-in-window mechanism comprising a plurality of dogs and a plurality of windows, and each dog is configured to move radially through a respective window to lock with a mating structure of the flow control housing.

6. The system of claim 1, wherein the flow control housing comprises a landing system configured to guide the flow control insert into the flow control housing.

7. The system of claim 1, wherein the flow control insert comprises a support, the choke valve is coupled to the support, and the check valve is coupled to the support.

8. The system of claim 1, wherein the check valve is directly coupled to the choke valve.

9. The system of claim 8, wherein the check valve comprises first threads, the choke valve comprises second threads, and the first and second threads are coupled together.

10. The system of claim 8, wherein the check valve and the choke valve are welded or brazed together.

11. The system of claim 8, wherein the check valve and the choke valve comprise a single sleeve, the single sleeve comprises a plurality of flow control openings of the choke valve, and the single sleeve supports the second valve member of the check valve between an open position and a closed position.

12. The system of claim 1, wherein the choke valve comprises a choke trim having a choke cage with one or more openings configured to choke a fluid flow along the fluid flow path.

13. The system of claim 12, wherein the choke trim comprises the first valve member configured to move along the choke cage between first and second positions, the one or more openings are not blocked by the plug or sleeve in the first positions, and the plurality of openings are at least partially blocked by the plug or sleeve in the second position.

14. A system, comprising:

a subsea fluid injection system or a mineral extraction system, comprising:

a flow control insert comprising a choke valve having a first valve member and a check valve having a second valve member disposed along a fluid flow path, the choke valve and the check valve are structurally different from one another, the first and second valve members are configured to move independent from one another, the flow control insert couples together the choke valve and the check valve, and the flow control insert is independently insertable and retrievable relative to a flow control housing; and an actuator selectively controllable to adjust a choked flow through the choke valve.

15. The system of claim 14, wherein the flow control insert comprise a support, the choke valve is coupled to the support, and the check valve is coupled to the support.

16. The system of claim 14, wherein the check valve is directly coupled to the choke valve.

17. The system of claim 14, wherein the choke valve comprises a choke trim, the choke trim comprising a needle and seat choke trim, a fixed bean choke trim, a plug and cage choke trim, an external sleeve choke trim, a multistage choke trim, or any combination thereof.

18. A system, comprising:

a subsea fluid injection system or a mineral extraction system, comprising:

a check valve comprising a body, a fluid passage through the body, a check valve element disposed in the fluid passage, and a choke mount, wherein the choke mount is configured to couple the check valve directly to a choke valve of a flow control insert, the choke valve and the check valve are structurally different from one another, the check valve element of the check valve is configured to move independent from a choke valve element of the choke valve, and a choked flow through the choke valve is adjustable via a selectively controllable actuator.

19. The system of claim 18, comprising a flow control insert having the check valve directly coupled to the choke valve.

20. The system of claim 19, wherein the choke mount comprises a threaded mounting interface.

21. The system of claim 18, comprising the actuator selectively controllable to adjust the choked flow through the choke valve.

22. The system of claim 1, wherein the actuator comprises one or more gears, a stepping mechanism, a hydraulic drive, or any combination thereof.

23. The system of claim 1, wherein the choke valve comprises a plurality of openings configured to choke the flow and the first valve member configured to move along a path adjacent the plurality of openings, and the actuator is coupled to the first valve member.

24. The system of claim 18, comprising the choke valve coupled to the choke mount.

25. The system of claim 14, wherein the choke valve comprises a plurality of radial openings configured to choke the flow and the first valve member configured to move along a path adjacent the plurality of radial openings.

26. The system of claim 25, wherein the plurality of radial openings comprise one or more radial openings sized less than half of a diameter of the fluid flow path.

27. The system of claim 25, wherein the moveable first valve is configured to selectively move between an open position and a closed position of the plurality of radial openings.

* * * * *